US010946264B2

(12) United States Patent
Bawden

(10) Patent No.: US 10,946,264 B2
(45) Date of Patent: Mar. 16, 2021

(54) REDUCED CONTACT LENGTH SNOWBOARDS AND SPLITBOARDS

(71) Applicant: Cardiff Snowcraft, Bountiful, UT (US)

(72) Inventor: Samuel J. Bawden, Bountiful, UT (US)

(73) Assignee: Cardiff Backcountry Colab LLC, Bountiful, UT (US)

( * ) Notice: Subject to any disclaimer, the term of this patent is extended or adjusted under 35 U.S.C. 154(b) by 0 days.

(21) Appl. No.: 16/378,687

(22) Filed: Apr. 9, 2019

(65) Prior Publication Data

US 2019/0308087 A1 Oct. 10, 2019

Related U.S. Application Data

(63) Continuation of application No. 29/643,515, filed on Apr. 9, 2018.

(60) Provisional application No. 62/655,199, filed on Apr. 9, 2018.

(51) Int. Cl.
*A63C 5/03* (2006.01)
*A63C 5/04* (2006.01)
*A63C 5/052* (2006.01)

(52) U.S. Cl.
CPC ..... *A63C 5/0405* (2013.01); *A63C 5/031* (2013.01); *A63C 5/052* (2013.01)

(58) Field of Classification Search
CPC ..... A63C 5/031; A63C 5/052; A63C 5/0405
See application file for complete search history.

(56) References Cited

U.S. PATENT DOCUMENTS

| | | | | |
|---|---|---|---|---|
| D346,194 | S * | 4/1994 | Ferris | D12/11 |
| D418,545 | S | 1/2000 | Cassel | |
| D561,860 | S | 2/2008 | Carlson et al. | |
| 7,798,514 | B2 * | 9/2010 | Canaday | A63C 5/03 280/600 |
| 9,327,180 | B2 * | 5/2016 | Adamczewski | A63C 5/0405 |
| D777,278 | S | 1/2017 | Warburton et al. | |
| 2004/0084878 | A1 * | 5/2004 | Adamczewski | A63C 5/003 280/602 |
| 2007/0170694 | A1 * | 7/2007 | Adamczewski | A63C 5/003 280/607 |
| 2008/0185814 | A1 * | 8/2008 | Riepler | A63C 5/02 280/601 |
| 2011/0272920 | A1 * | 11/2011 | Adamczewski | A63C 5/0405 280/601 |

(Continued)

FOREIGN PATENT DOCUMENTS

EP 1935459 A1 6/2008

OTHER PUBLICATIONS

International Search Report and Written Opinion for corresponding PCT/US19/26440, dated Jun. 25, 2019.

*Primary Examiner* — Bryan A Evans
(74) *Attorney, Agent, or Firm* — Elevated IP, LLC

(57) ABSTRACT

Snowboards and splitboards having a contact length less than or equal to 65% of the length of the snowboard or a contact length equal to or less than half the length of the snowboard are disclosed. In some embodiments, a peak of a cambered section is aligned with a horizontal midline of the snowboard. In other embodiments, a peak of a cambered section is aft of a horizontal midline of the snowboard. Optional features of the snowboards and splitboards include bi-lobed tips, bi-lobed tails, touring tails and/or dual recurved tails.

19 Claims, 10 Drawing Sheets

(56) References Cited

U.S. PATENT DOCUMENTS

| | | | |
|---|---|---|---|
| 2013/0193672 | A1 | 8/2013 | Bulan |
| 2017/0050105 | A1 | 2/2017 | Browning |

* cited by examiner

REDUCED CONTACT LENGTH SNOWBOARDS AND SPLITBOARDS

CROSS-REFERENCE TO RELATED APPLICATIONS

This application claims the benefit of and priority to U.S. Provisional Patent Application No. 62/655,199 and U.S. Design patent application No. 29/643,515, both filed Apr. 9, 2018, and each of which is hereby incorporated by reference in its entirety.

BACKGROUND

The shape of a snowboard significantly impacts its riding characteristics, with several long-standing beliefs dominating nearly all current design. For example, a traditional snowboard intended for turning stability will have a relatively long effective edge, while a snowboard designed for flat basing, spinning and maneuverability will have a relatively long contact length. Thus, with traditional designs, a higher effective edge to contact length (EE-to-CL) ratio will provide a stable and forgiving ride, but will also lead to less maneuverability and a slower turn response, whereas a lower EE-to-CL ratio will give a sharper, tighter turn response and less stability. In attempting to balance stability and maneuverability, most snowboard designs come close to matching the effective edge to the contact length, thereby achieving an EE-to-CL ratio of about 1:1.

SUMMARY

The present invention provides snowboards and splitboards with non-traditional shapes. Relative to traditional snowboards, the present snowboards and splitboards have slightly reduced effective edge lengths and significantly reduced contact lengths. For example, a contact length of a snowboard disclosed herein may be less than or equal to 65% of the length of the snowboard, or a contact length of a snowboard disclosed herein may be equal to or less than half the length of the snowboard. Thus, the EE-to-CL ratios of the disclosed snowboards and splitboards are significantly greater than 1:1.

The short contact length of the disclosed snowboards and splitboards allows the front contact point to be moved closer to, if not underneath, the front foot. Pulling the front contact point back toward the front foot, relative to a traditional snowboard, provides maneuverability and responsiveness and allows for a gradually rockered tip rather than an abrupt one. The gradual rocker allows for less friction in softer snow (i.e., less pushing of snow by a more abruptly angled tip) and increased glide. The gradual rocker in the nose also more accurately matches the bend that the board needs to make in order to be set on edge. Rather than bending the board to create the arc of a turn, the snowboard is already rockered into the turn.

The shortened effective edge lengths of the disclosed snowboards and splitboards, relative to traditional snowboards, leads to a counterintuitive shape—where less edge contact is sufficient for good turning. This is achieved by a gradual sidecut before and after the edge contact point that allows the board to glide in and out of turns and that seems to extend the effective edge in slightly softer snow. Thus, in softer snow the benefit of longer edge hold is achieved without sacrificing maneuverability. The reduced effective edge in combination with reduced contact length found in the disclosed snowboards and splitboards completely disregards current snowboard shaping norms.

In an aspect, a snowboard comprises a rockered tip, a rockered tail, and a cambered section between the rockered tip and the rockered tail, wherein a contact length of the snowboard is less than or equal to 65%, or 63%, or 60%, or 58%, or 56%, or 55%, or 53%, or 50% of the length of the snowboard.

In an aspect, a snowboard comprises a rockered tip, a rockered tail, and one cambered section between the rockered tip and the rockered tail, wherein a contact length of the snowboard is equal to or less than half the length of the snowboard.

In an embodiment, the snowboard is separated into two pieces along a longitudinal centerline to form a splitboard.

In an aspect, a snowboard, separated into two pieces along a longitudinal centerline to form a splitboard, comprises a bi-lobed tip and a bi-lobed tail.

In an aspect, a snowboard, separated into two pieces along a longitudinal centerline to form a splitboard, comprises a bi-lobed tip and a dual recurved tail.

In an aspect, a snowboard, separated into two pieces along a longitudinal centerline to form a splitboard, comprises a dual recurved tail.

In an embodiment, a peak of a cambered section is aligned with a horizontal midline of the snowboard. In another embodiment, a peak of the cambered section is aft of a horizontal midline of the snowboard. For example, the peak of the cambered section may be aft of the horizontal midline of the snowboard by at least 175 mm, or at least 200 mm, or at least 215 mm. In an embodiment, the peak of the cambered section is aft of the horizontal midline of the snowboard by a distance selected from 175 mm to 230 mm, or from 175 mm to 215 mm, or from 185 mm to 200 mm. Generally, the location of the peak of the cambered section varies with the overall length of the snowboard with longer snowboards having a peak camber location further aft of the horizontal midline of the snowboard than shorter snowboards. For example, in an embodiment, a snowboard with an overall length of 162 cm has a peak camber location about 215 mm aft of the horizontal midline of the snowboard, whereas a snowboard with an overall length of 152 cm has a peak camber location about 175 mm aft of the horizontal midline of the snowboard. As used herein, in an embodiment, "aft of a horizontal midline of a snowboard" refers to an area closer to a tail of the snowboard. Of course, "aft of a horizontal midline for a twin or bi-directional snowboard" may refer to an area closer to the nose of the snowboard.

In an embodiment, the peak of the cambered section has a height greater than or equal to 1 mm, or greater than or equal to 2 mm, or greater than or equal to 4 mm, or greater than or equal to 5 mm. In an embodiment, the peak of the cambered section has a height between 1 mm and 7 mm, or between 2 mm and 7 mm, or between 3 mm and 7 mm, or between 4 mm and 7 mm, or between 5 mm and 7 mm.

In an embodiment, a ratio of the effective edge to the contact length is at least 1.1, or at least 1.2, or at least 1.3, or at least 1.4 or at least 1.5. In an embodiment, a ratio of the effective edge to the contact length is between 1.1 and 1.6, or between 1.2 and 1.5, or between 1.3 and 1.5.

In an embodiment, a ratio of the overall length to the effective edge of the snowboard is at least 1.30, or at least 1.33, or at least 1.35, or at least 1.45, or at least 1.5, or at least 1.55. In an embodiment, a ratio of the overall length to the effective edge of the snowboard is between 1.30 and 1.60, or between 1.33 and 1.55, or between 1.35 and 1.5, or between 1.35 and 1.45, or between 1.35 and 1.4.

In an embodiment, a rockered tip of the snowboard begins at or forward of the first front binding inserts. For example, in an embodiment, a rockered tip begins forward of the first front binding inserts by up to 180 mm, or up to 150 mm, or up to 125 mm, or up to 100 mm, or up to 75 mm, or up to 50 mm, or up to 20 mm.

In an embodiment, a rockered tip rises 60 mm to 85 mm, or 60 mm to 75 mm, or 60 mm to 70 mm, or 65 mm to 80 mm, from the beginning of the rockered tip to the virtual front point of the snowboard. In an embodiment, a rockered tip rises between 0.08 mm/mm and 0.25 mm/mm, or between 0.1 mm/mm and 0.23 mm/mm, or between 0.14 mm/mm and 0.20 mm/mm.

In an embodiment, a rockered tail of the snowboard begins at or forward of the first rear binding inserts. For example, in an embodiment, a rockered tail begins forward of the first rear binding inserts by up to 180 mm, or up to 150 mm, or up to 125 mm, or up to 100 mm, or up to 75 mm, or up to 50 mm, or up to 20 mm.

In an embodiment, a rockered nose and/or tail may be stiffer than other portions of a snowboard to minimize bouncing or chatter of the rockered section(s) of the snowboard.

In an embodiment, each of the two pieces of a splitboard comprises a substantially rounded tip, a substantially rounded tail or both. In an embodiment, a snowboard or splitboard comprises a bi-lobed tip, a bi-lobed tail or both. In an embodiment, one or more inside corners of each of the two pieces of a splitboard are chamfered. In an embodiment, one or more inside corners of each of the two pieces of a splitboard are rounded but not chamfered (i.e., beveled). In an embodiment, the one or more inside corners are disposed within a nose region of the snowboard, within a tail region of the snowboard or both.

In an embodiment, a splitboard comprises a "tour tail" comprising means within the tail of each piece of the splitboard for receiving a tail hook of a climbing skin. Thus, a "tour tail" design allows a splitboarder to not only use climbing skins made for snowboards, but also those created for skis. In an embodiment, each of the two pieces of a splitboard comprises a notch in a back edge of the piece. In an embodiment, each of the two pieces of a splitboard comprises a notch substantially at a mid-section of a back edge of the piece.

In an aspect, a method of making a snowboard comprises forming a snowboard comprising a rockered tip, a rockered tail, and a cambered section between the rockered tip and the rockered tail, wherein a contact length of the snowboard is less than or equal to 65%, or 63%, or 60%, or 58%, or 56%, or 55%, or 53%, or 50% of the length of the snowboard.

In an aspect, a method of making a snowboard comprises forming a snowboard comprising a rockered tip, a rockered tail, and a cambered section between the rockered tip and the rockered tail, wherein a contact length of the snowboard is equal to or less than half the length of the snowboard.

In an embodiment, a method of making a snowboard further comprises separating the snowboard into two pieces along a longitudinal centerline to form a splitboard.

Generally, snowboards and splitboards disclosed herein have shortened effective edge dimensions relative to known snowboards. This allows the edge contact points to be formed as very gradual arcs, which allows the snowboard to glide better in and out of turns, and reduces the need to make the tip and tail significantly wider than the waist in order to make turning easier. Thus, the shapes of the disclosed snowboards are directly affected by the reduced effective edge dimensions. For example, a snowboard disclosed herein may have a 300 mm tip width, 295 mm tail width and 250 mm waist width. In another embodiment, a snowboard disclosed herein may have a 300 mm tip width, 297.5 mm tail width and 262 mm waist width.

Snowboards and splitboards disclosed herein may be manufactured by techniques known in the art, including, but not limited to, laminating together layers of metal, wood, carbon fiber, plastic, foam and combinations thereof.

BRIEF DESCRIPTION OF THE DRAWINGS

Illustrative embodiments of the present invention are described in detail below with reference to the attached drawings, wherein.

DETAILED DESCRIPTION

Figure 1:
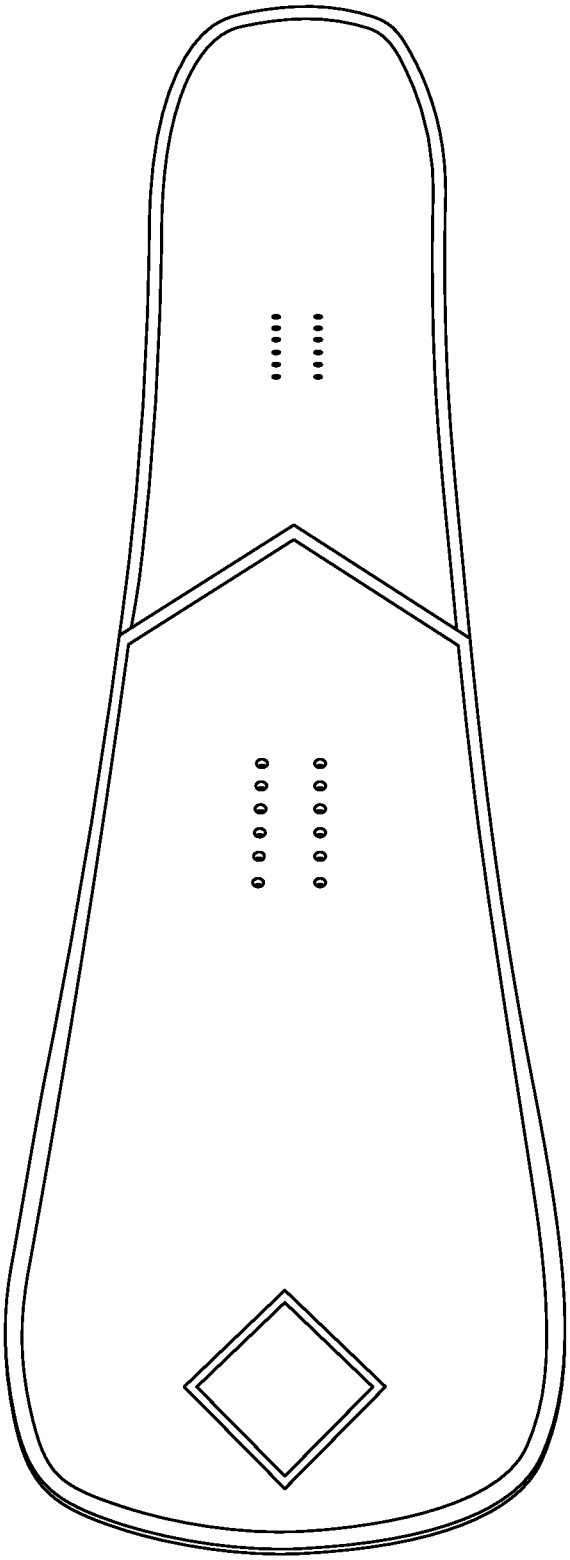
FIG. 1 is a top perspective view of an embodiment of a snowboard or splitboard comprising a uni-lobed tip and a uni-lobed tail.

In general, the terms and phrases used herein have their art-recognized meaning, which can be found by reference to standard texts, journal references and contexts known to those skilled in the art. The following definitions are provided to clarify their specific use in the context of this description.

As used herein, a "contact point" refers to a point of contact between the base of a snowboard and the ground or snow.

As used herein, "contact length" refers to the length of the snowboard in a straight line between the contact points when the snowboard is weighted by the rider.

As used herein, "effective edge" refers to the length of the metal edge of a snowboard from the widest point on the nose to the widest point on the tail.

As used herein, "rockered" refers to the shape of an object or portion of an object that is curved along its base. For example, a rockered tip of a snowboard rises at an increasing rate of rise from a point of contact between the base of the snowboard and the ground to the tip of the snowboard.

As used herein, "camber" refers to an arched shape of a horizontal surface. For example, a cambered section of a snowboard is curved or convex when viewed in side profile with the peak of the convexity above the surface that is supporting the bottom of the snowboard.

As used herein, "chamfered" refers to a beveled edge connecting planes that would otherwise meet to form a right-angled corner. Thus, chamfering removes and substantially rounds a right-angled corner to form a lobe. In an embodiment, the beveled edge is a 45-degree beveled edge.

As used herein, "bi-lobed" refers to an object or a portion of an object having two lobes (substantially roundish and flattish projections).

As used herein, "recurved" refers to an object or a portion of an object, such as a surface or edge, having an "S"-shaped form factor. Thus, a recurved object is curved or bent in one direction, then curved or bent in the opposite direction, thereby forming two inflection points. In some embodiments, each piece of a splitboard is recurved, and a complete snowboard or splitboard comprising these pieces has a "dual recurved" tail.

"Proximal" and "distal" refer to the relative positions of two or more objects, planes or surfaces. For example, an object that is close in space to a reference point relative to the position of another object is considered proximal to the reference point, whereas an object that is further away in space from a reference point relative to the position of another object is considered distal to the reference point.

The terms "direct and indirect" describe the actions or physical positions of one object relative to another object. For example, an object that "directly" acts upon or touches another object does so without intervention from an intermediary. Contrarily, an object that "indirectly" acts upon or touches another object does so through an intermediary (e.g., a third object).

Exemplary snowboards and splitboards can be seen in FIGS. 1-20, which are described hereafter.

FIG. 1 is a top perspective view of a first embodiment of a snowboard or splitboard comprising a uni-lobed tip and a uni-lobed tail.

Figure 2:
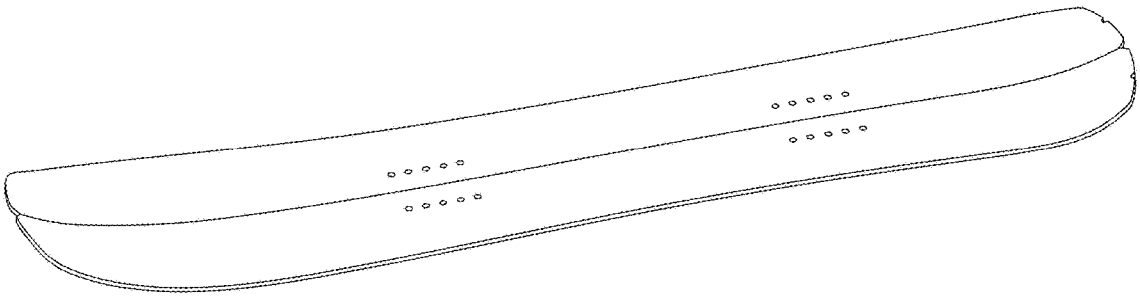
FIG. 2 is a top perspective view of an embodiment of a snowboard or splitboard comprising a bi-lobed tip, a bi-lobed tail and tail notches.
Figure 3:
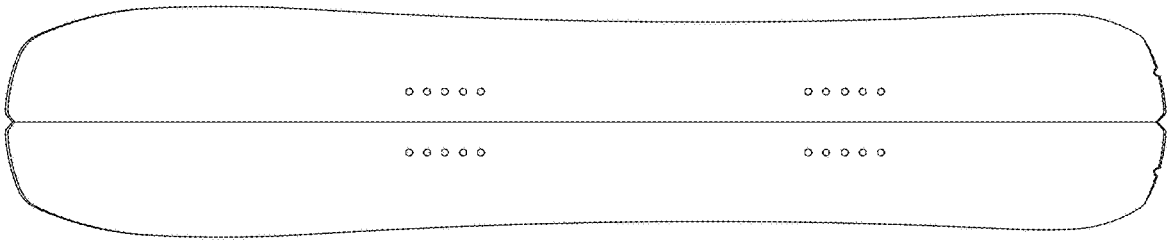
FIG. 3 is a top plan view of the embodiment of FIG. 2.
Figure 4:
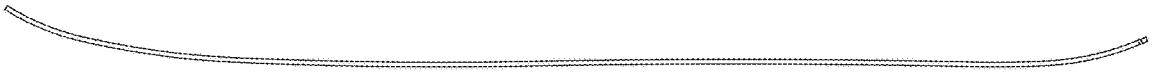
FIG. 4 is a first side view of the embodiment of FIG. 2, the opposite, second side view being a mirror image of the first side view.
Figure 5:
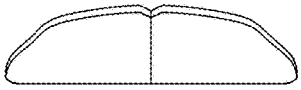
FIG. 5 is a front view of the embodiment of FIG. 2.
Figure 6:
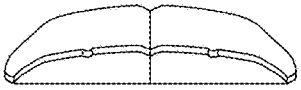
FIG. 6 is a rear view of the embodiment of FIG. 2.

FIG. 2 is a top perspective view of an embodiment of a snowboard or splitboard comprising a bi-lobed tip, a bi-lobed tail and tail notches; FIG. 3 is a top plan view of the embodiment of FIG. 2; FIG. 4 is a first side view of the embodiment of FIG. 2, the opposite, second side view being a mirror image of the first side view; FIG. 5 is a front view of the embodiment of FIG. 2; and FIG. 6 is a rear view of the embodiment of FIG. 2. Snowboards and splitboards in accordance with this disclosure may include only a bi-lobed tip, only a bi-lobed tail, only tail notches or combinations of these features.

Figure 7:
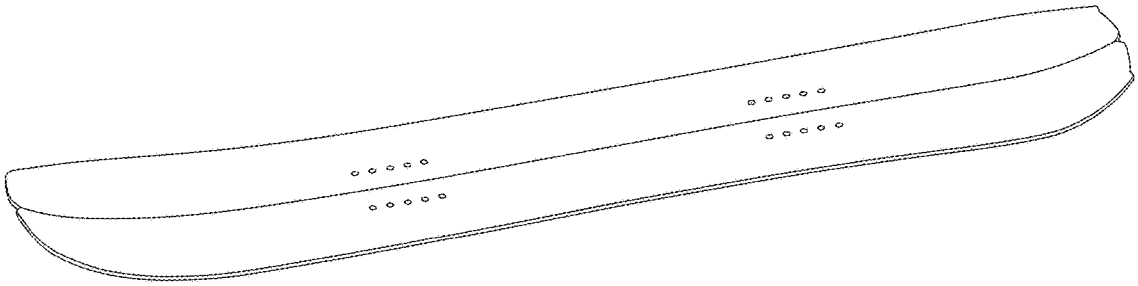
FIG. 7 is a top perspective view of an embodiment of a snowboard or splitboard comprising a bi-lobed tip and a dual recurved tail.
Figure 8:
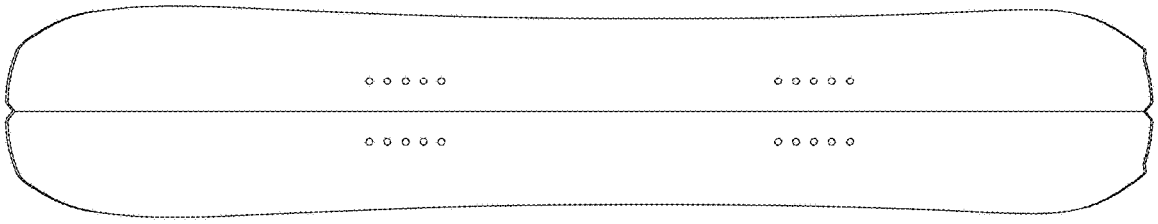
FIG. 8 is a top plan view of the embodiment of FIG. 7.
Figure 9:
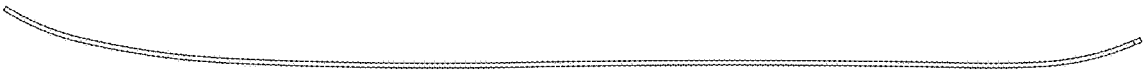
FIG. 9 is a first side view of the embodiment of FIG. 7, the opposite, second side view being a mirror image of the first side view.
Figure 10:
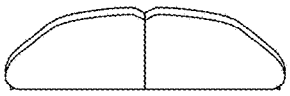
FIG. 10 is a front view of the embodiment of FIG. 7.
Figure 11:
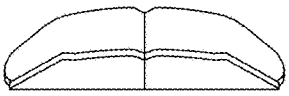
FIG. 11 is a rear view of the embodiment of FIG. 7.

FIG. 7 is a top perspective view of an embodiment of a snowboard or splitboard comprising a bi-lobed tip and a dual recurved tail; FIG. 8 is a top plan view of the embodiment of FIG. 7; FIG. 9 is a first side view of the embodiment of FIG. 7, the opposite, second side view being a mirror image of the first side view; FIG. 10 is a front view of the embodiment of FIG. 7; and FIG. 11 is a rear view of the embodiment of FIG. 7. Snowboards and splitboards in accordance with this disclosure may include only a bi-lobed tip, only a dual recurved tail or combinations of these features.

Figure 12:
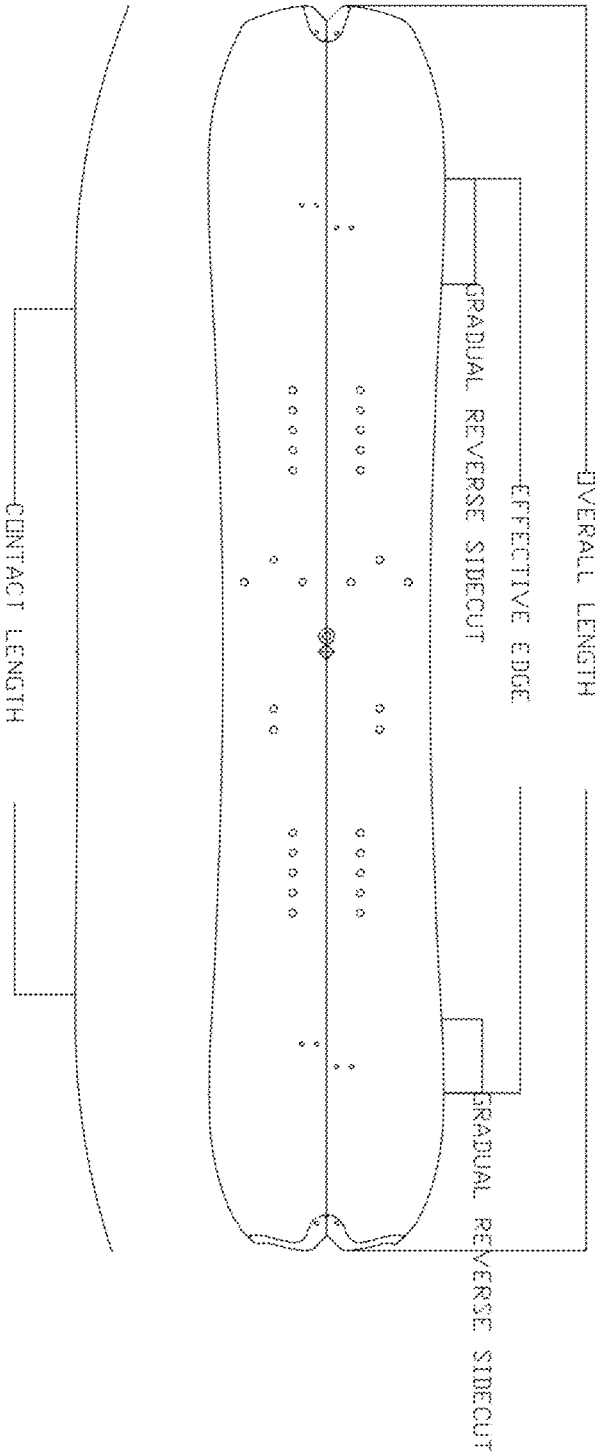
FIG. 12 is a schematic showing top and side plan views of an exemplary splitboard illustrating terminology used herein.

FIG. 12 is a schematic showing top and side plan views of an exemplary splitboard illustrating terminology used herein.

Figure 13:
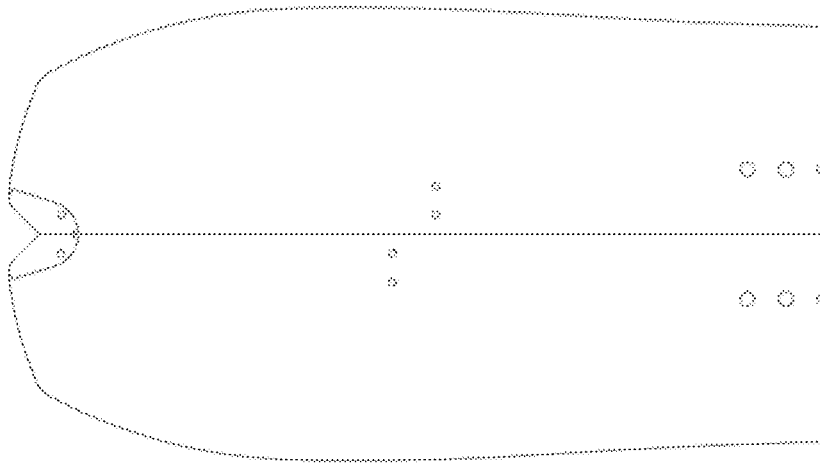
FIG. 13 is a schematic showing a close-up view of a tip of a splitboard having a bi-lobed or chamfered tip, according to an embodiment.

FIG. 13 is a schematic showing a close-up view of a tip of a splitboard having a bi-lobed or chamfered tip, according to an embodiment.

Figure 14:
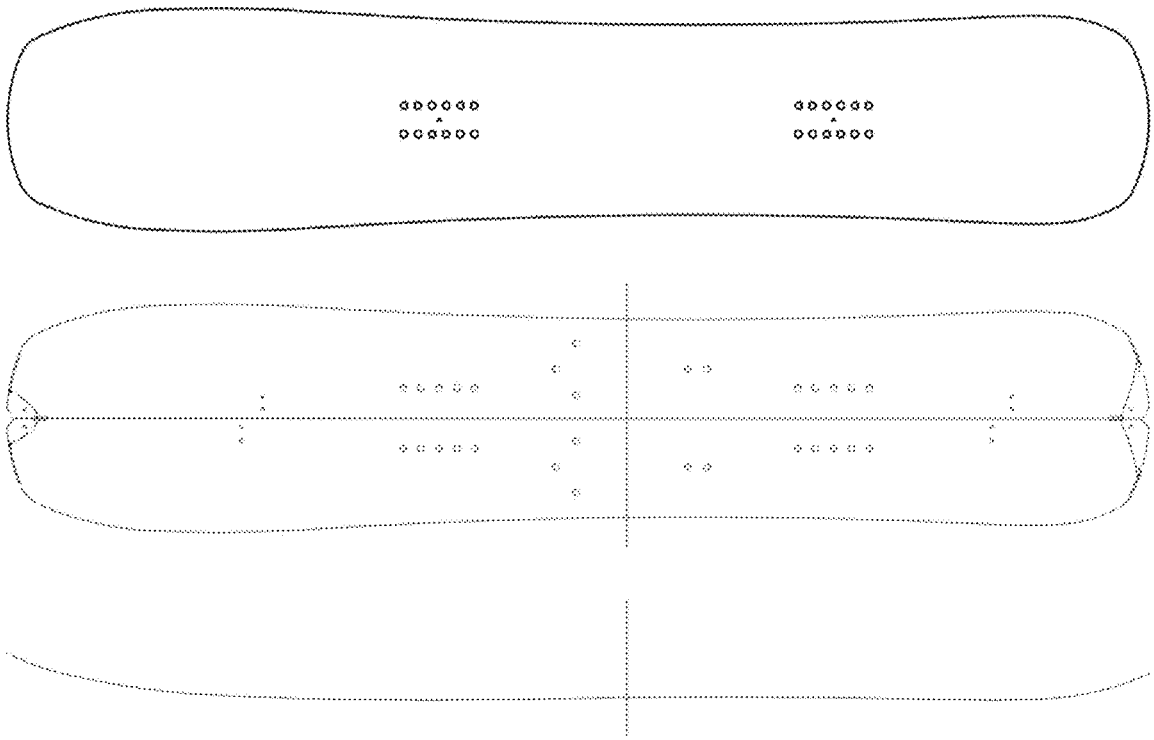
FIG. 14 is a schematic of a solid snowboard (top) and a splitboard (middle) having the same side profile (bottom); the splitboard has a bi-lobed tip, a bi-lobed tail and tail notches, according to an embodiment.

FIG. 14 is a schematic of a solid snowboard (top) and a splitboard (middle) having the same side profile (bottom); the splitboard has a bi-lobed tip, a bi-lobed tail and tail notches, according to an embodiment.

Figure 15:
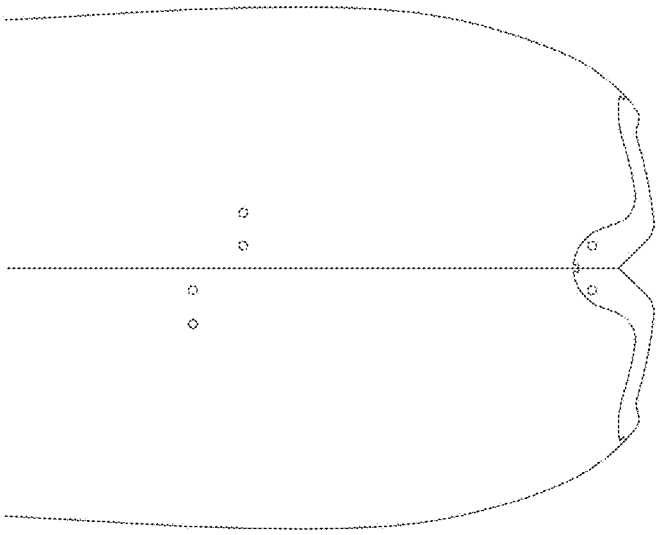
FIG. 15 is a schematic showing a close-up view of a tail of a splitboard having a dual recurved tail, according to an embodiment.

FIG. 15 is a schematic showing a close-up view of a tail of a splitboard having a dual recurved tail, according to an embodiment.

Figure 16:
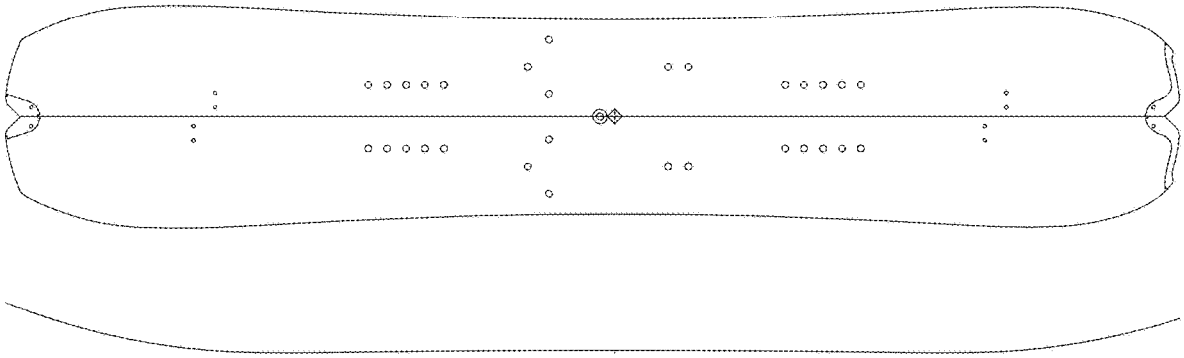
FIG. 16 is a schematic showing top and side views of a splitboard having a rockered, bi-lobed tip, a rockered, dual recurved tail, and a cambered section, according to an embodiment.

FIG. 16 is a schematic showing top and side views of a splitboard having a rockered, bi-lobed tip, a rockered, dual recurved tail, and a cambered section, according to an embodiment.

Figure 17:
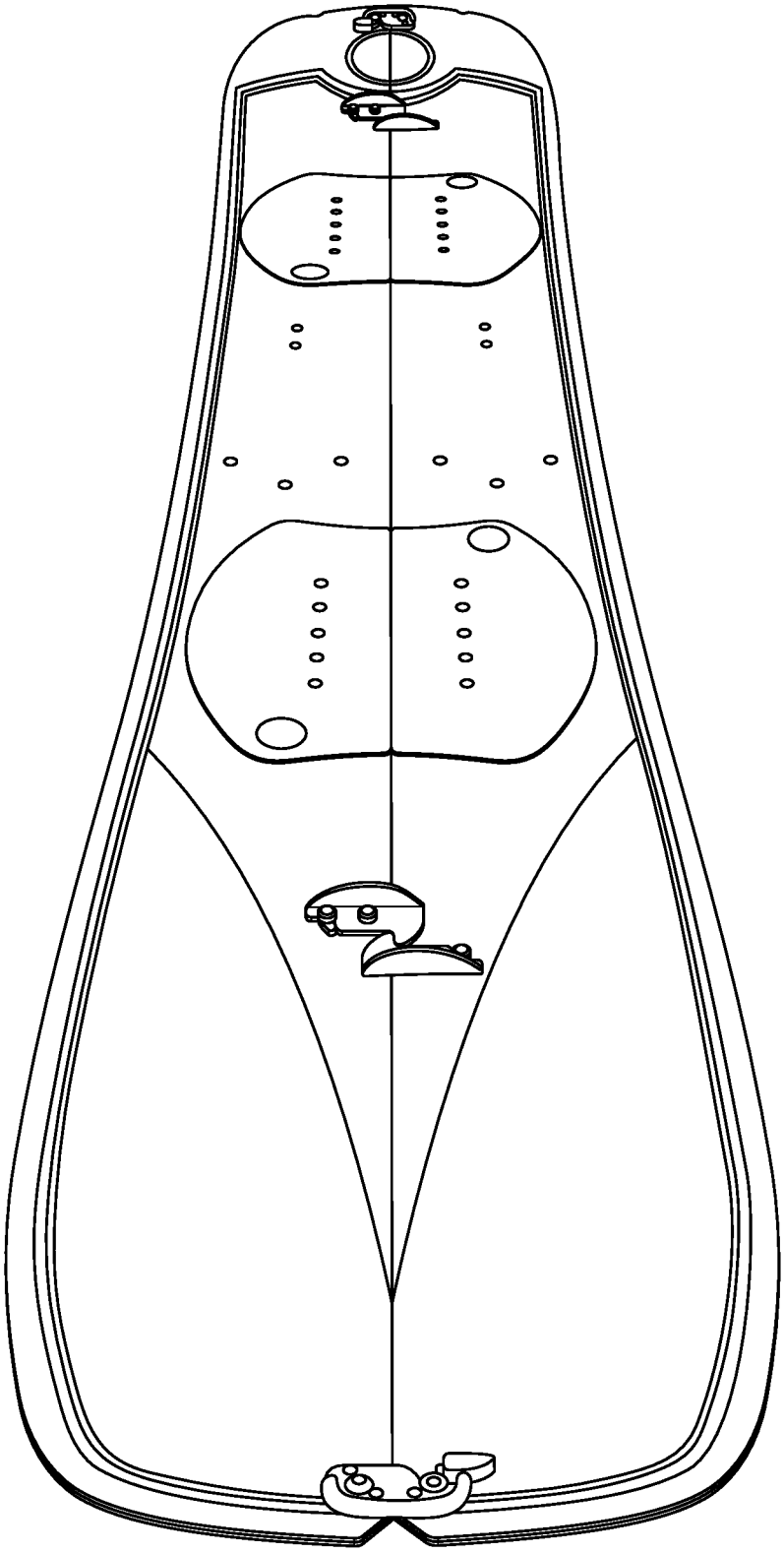
FIG. 17 is a photograph of a splitboard comprising a rockered, bi-lobed tip, according to an embodiment.
Figure 18:
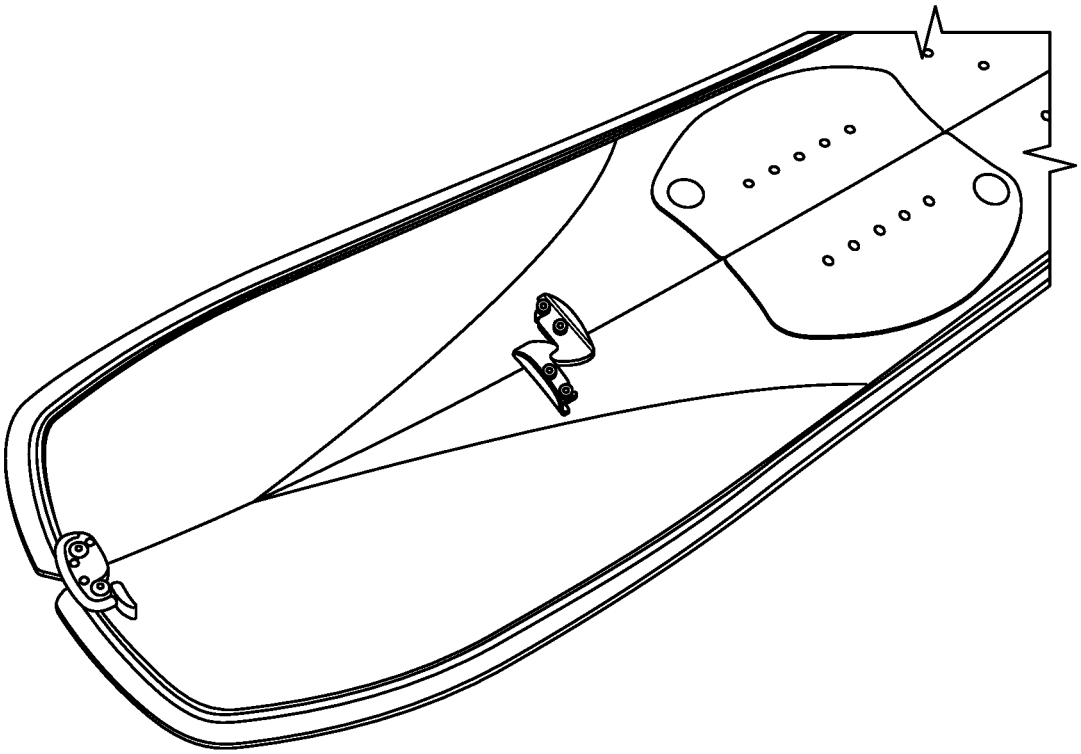
FIG. 18 is a close-up view of the tip of the splitboard shown in FIG. 17.
Figure 19:
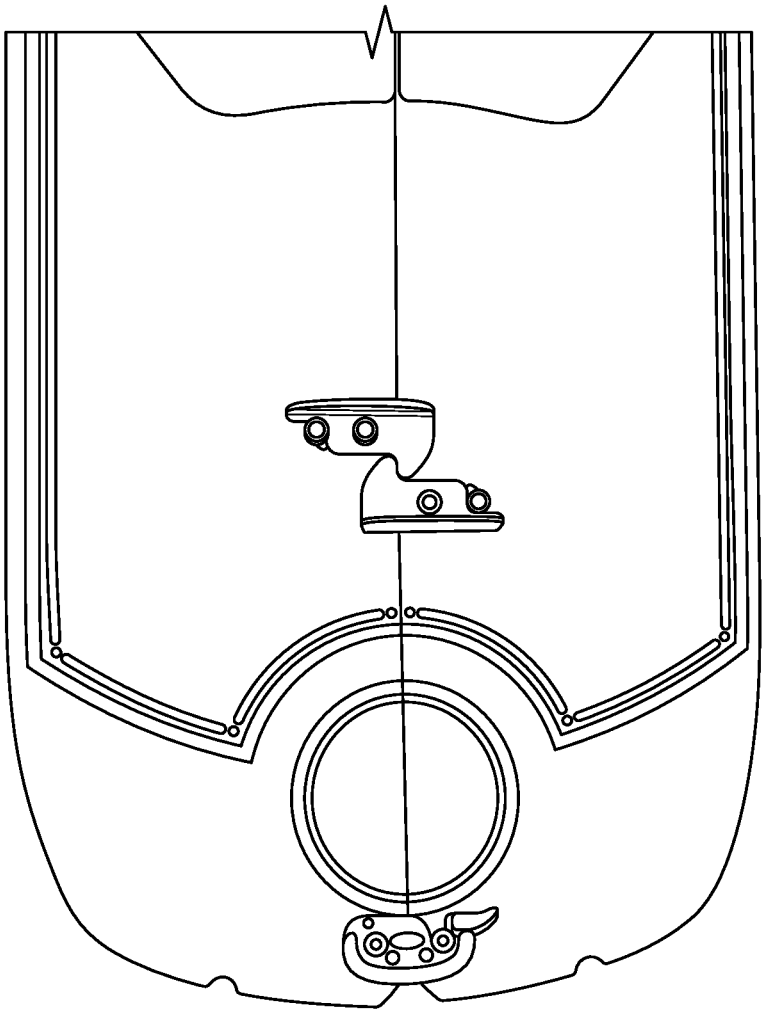
FIG. 19 is a close-up view of the tail of the splitboard shown in FIG. 17, showing the bi-lobed tail and tail notches.
Figure 20:
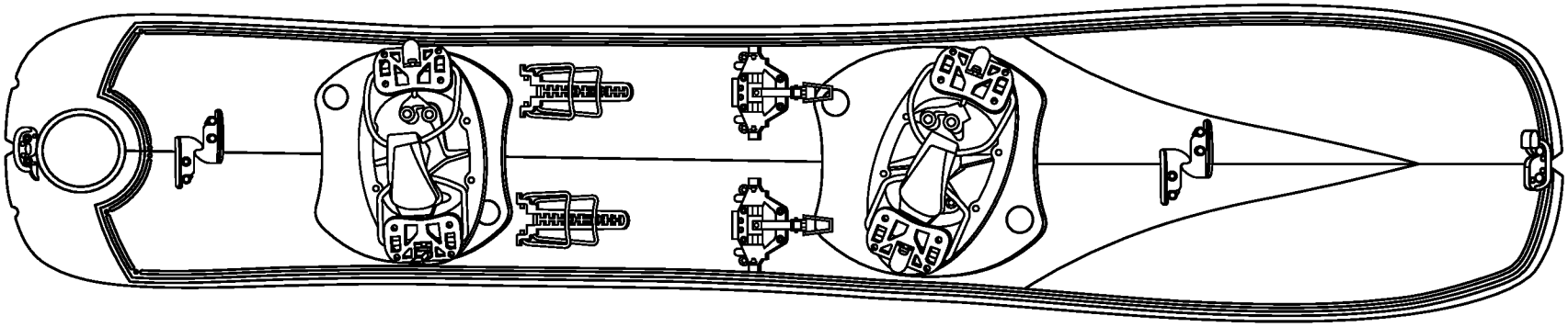
FIG. 20 is a photograph of the splitboard of FIG. 17 with bindings attached.

FIG. 17 is a photograph of a splitboard comprising a rockered, bi-lobed tip, according to an embodiment; FIG. 18 is a close-up view of the tip of the splitboard shown in FIG. 17; FIG. 19 is a close-up view of the tail of the splitboard shown in FIG. 17, showing the bi-lobed tail and tail notches; and FIG. 20 is a photograph of the splitboard of FIG. 17 with bindings attached.

STATEMENTS REGARDING INCORPORATION BY REFERENCE AND VARIATIONS

All references cited throughout this application, for example patent documents including issued or granted patents or equivalents; patent application publications; and non-patent literature documents or other source material; are hereby incorporated by reference herein in their entireties, as though individually incorporated by reference.

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the invention has been specifically disclosed by preferred embodiments, exemplary embodiments and optional features, modification and variation of the concepts herein disclosed can be resorted to by those skilled in the art, and that such modifications and variations are considered to be within the scope of this invention as defined by the appended claims. The specific embodiments provided herein are examples of useful embodiments of the invention and it will be apparent to one skilled in the art that the invention can be carried out using a large number of variations of the devices, device components, and method steps set forth in the present description. As will be apparent to one of skill in the art, methods and devices useful for the present methods and devices can include a large number of optional composition and processing elements and steps.

When a group of substituents is disclosed herein, it is understood that all individual members of that group and all subgroups are disclosed separately. When a Markush group or other grouping is used herein, all individual members of the group and all combinations and subcombinations possible of the group are intended to be individually included in the disclosure.

It must be noted that as used herein and in the appended claims, the singular forms "a", "an", and "the" include plural reference unless the context clearly dictates otherwise. Thus, for example, reference to "a notch" includes a plurality of such notches and equivalents thereof known to those skilled in the art, and so forth. As well, the terms "a" (or "an"), "one or more" and "at least one" can be used interchangeably herein. It is also to be noted that the terms "comprising", "including", and "having" can be used interchangeably. The expression "of any of claims XX-YY" (wherein XX and YY refer to claim numbers) is intended to provide a multiple dependent claim in the alternative form, and in some embodiments is interchangeable with the expression "as in any one of claims XX-YY."

Unless defined otherwise, all technical and scientific terms used herein have the same meanings as commonly understood by one of ordinary skill in the art to which this invention belongs. Although any methods and materials similar or equivalent to those described herein can be used in the practice or testing of the present invention, the preferred methods and materials are described. Nothing herein is to be construed as an admission that the invention is not entitled to antedate such disclosure by virtue of prior invention.

Whenever a range is given in the specification, for example, a range of integers, a temperature range, a time range, a composition range, or concentration range, all intermediate ranges and subranges, as well as all individual values included in the ranges given are intended to be included in the disclosure. As used herein, ranges specifically include the values provided as endpoint values of the range. As used herein, ranges specifically include all the integer values of the range. For example, a range of 1 to 100 specifically includes the end point values of 1 and 100. It will be understood that any subranges or individual values in a range or subrange that are included in the description herein can be excluded from the claims herein.

As used herein, "comprising" is synonymous and can be used interchangeably with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" can be replaced with either of the other two terms. The invention illustratively described herein suitably can be practiced in the absence of any element or elements or limitation or limitations which is/are not specifically disclosed herein.

All art-known functional equivalents of materials and methods are intended to be included in this disclosure. The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the invention has been specifically disclosed by preferred embodiments and optional features, modification and variation of the concepts herein disclosed can be resorted to by those skilled in the art, and that such modifications and variations are considered to be within the scope of this invention as defined by the appended claims.

What is claimed is:

1. A snowboard comprising a rockered tip, a rockered tail, and one cambered section between the rockered tip and the rockered tail, wherein a ratio of an effective edge to a contact length of the snowboard is at least 1.1, and wherein the rockered tail is a dual recurved tail.

2. The snowboard of claim 1, wherein a contact length of the snowboard is equal to or less than half the length of the snowboard.

3. The snowboard of claim 1, wherein a peak of the cambered section is aligned with a horizontal midline of the snowboard.

4. The snowboard of claim 1, wherein a peak of the cambered section is aft of a horizontal midline of the snowboard.

5. The snowboard of claim 1, wherein a front contact point is underneath a front binding location.

6. The snowboard of claim 1, wherein a ratio of the effective edge to the contact length is between 1.1 and 1.6.

7. The snowboard of claim 1, wherein a ratio of the overall length to the effective edge of the snowboard is between 1.30 and 1.60.

8. The snowboard of claim 1, wherein the rockered tail begins at or forward of the first rear binding inserts.

9. The snowboard of claim 1, wherein the snowboard is separated into two pieces along a longitudinal centerline to form a splitboard.

10. The snowboard of claim 9, wherein each of the two pieces comprises a substantially rounded tip, a substantially rounded tail or both.

11. The snowboard of claim 9 further comprising a bi-lobed tip, a bi-lobed tail or both.

12. The snowboard of claim 9, wherein one or more inside corner(s) of each of the two pieces is/are chamfered.

13. The snowboard of claim 12, wherein the one or more inside corner(s) is/are disposed within a nose region of the snowboard, within a tail region of the snowboard or both.

14. The snowboard of claim 9, wherein each of the two pieces comprises a notch in a back edge of the piece.

15. The snowboard of claim 9, wherein each of the two pieces comprises a notch substantially at a mid-section of a back edge of the piece.

16. The snowboard of claim 9, wherein a front contact point is underneath a front binding location.

17. A method of making a snowboard, comprising:

forming a snowboard comprising a rockered tip, a rockered tail, and a cambered section between the rockered tip and the rockered tail, wherein a ratio of an effective edge to a contact length of the snowboard is at least 1.1, and wherein the rockered tail is a dual recurved tail.

18. The method of claim 17, wherein a contact length of the snowboard is equal to or less than half the length of the snowboard.

19. The method of claim 17 further comprising separating the snowboard into two pieces along a longitudinal centerline to form a splitboard.

* * * * *